US007467423B1

(12) United States Patent
Tawfik

(10) Patent No.: US 7,467,423 B1
(45) Date of Patent: Dec. 23, 2008

(54) COLD WEATHER PROTECTION GARMENT

(76) Inventor: Shelley J. Tawfik, 14 Stone Gate La., Old Brookville, NY (US) 11545

( * ) Notice: Subject to any disclaimer, the term of this patent is extended or adjusted under 35 U.S.C. 154(b) by 171 days.

(21) Appl. No.: 11/179,373

(22) Filed: Jul. 12, 2005

Related U.S. Application Data

(63) Continuation of application No. 11/152,749, filed on Jun. 14, 2005, now abandoned, which is a continuation of application No. 10/881,504, filed on Jun. 30, 2004, now abandoned.

(51) Int. Cl.
*A41B 5/00* (2006.01)

(52) U.S. Cl. ..... 2/207

(58) Field of Classification Search ..... 2/468, 2/88, 91, 92, 206, 207, 208, 209, 247–252
See application file for complete search history.

(56) References Cited

U.S. PATENT DOCUMENTS

| | | | | | |
|---|---|---|---|---|---|
| 53,760 | A | | 4/1866 | Mahler | |
| D8,034 | S | | 1/1875 | Prindle | |
| 526,950 | A | | 10/1894 | Spring | |
| 552,670 | A | | 1/1896 | Riess | |
| 1,151,126 | A | * | 8/1915 | Robinson | 2/91 |
| 1,157,341 | A | | 10/1915 | Tallerday | |
| 1,176,482 | A | | 3/1916 | Orme | |
| 1,285,917 | A | | 11/1918 | Bradley et al. | |
| 1,936,045 | A | * | 11/1933 | Bachrach | 2/91 |
| 2,247,272 | A | * | 6/1941 | Becher | 2/91 |
| D134,638 | S | | 12/1942 | Melville | |
| D142,469 | S | | 10/1945 | Brodigan | |
| 2,413,318 | A | * | 12/1946 | Golfieri | 2/207 |
| 2,413,319 | A | * | 12/1946 | Golfieri | 2/171.01 |
| 2,479,731 | A | * | 8/1949 | Dibrell | 2/91 |
| 2,496,953 | A | | 2/1950 | Pinnere | |
| 2,620,478 | A | * | 12/1952 | Fraum | 2/91 |
| 2,806,222 | A | | 9/1957 | Carpenter | |
| 2,831,197 | A | * | 4/1958 | Spells | 2/203 |
| 2,835,896 | A | | 5/1958 | Giese | |
| 2,870,448 | A | | 1/1959 | Rosenthal | |
| 3,178,726 | A | | 4/1965 | Gringorten | |
| 3,286,276 | A | * | 11/1966 | Calisch | 2/91 |

(Continued)

FOREIGN PATENT DOCUMENTS

| | | |
|---|---|---|
| FR | 2 297 577 | 8/1976 |

(Continued)

OTHER PUBLICATIONS

U.S. Appl. No. 60/496,954, Charles Edmondson, Minneapolis, MN, Multi-purpose Scarf, filed Aug. 21, 2003, see entire document.*

*Primary Examiner*—Alissa L Hoey
(74) *Attorney, Agent, or Firm*—Schweitzer Cornman Gross & Bondell LLP

(57) ABSTRACT

A garment includes a scarf, a first muff, and a second muff. The scarf is configured to be wrapped around a person's neck in the traditional manner. Each of the muffs include a pocket for generally receiving one of the hands of the person wearing the garment. The garment preferably includes a coupler for maintaining an abutting relationship between the muffs. The garment can also include first and second ornamental extensions that are respectively connected to the first and second muffs.

10 Claims, 11 Drawing Sheets

U.S. PATENT DOCUMENTS

| | | | | | |
|---|---|---|---|---|---|
| 4,037,340 | A | * | 7/1977 | Owensmith | 40/586 |
| 4,109,321 | A | * | 8/1978 | Shapiro | 2/91 |
| 4,321,709 | A | | 3/1982 | Steinberg | |
| 4,488,315 | A | | 12/1984 | Hoerlein | |
| 4,559,647 | A | | 12/1985 | Smith et al. | |
| D314,080 | S | | 1/1991 | Owens | |
| D315,640 | S | | 3/1991 | Pelzel | |
| 5,241,706 | A | * | 9/1993 | Netz | 2/66 |
| 5,265,669 | A | * | 11/1993 | Schneider | 165/46 |
| 5,293,646 | A | | 3/1994 | Winston | |
| 5,499,401 | A | * | 3/1996 | Heinmiller | 2/208 |
| 5,720,049 | A | | 2/1998 | Clutton | |
| 5,903,924 | A | * | 5/1999 | Garbit | 2/207 |
| D431,892 | S | | 10/2000 | Maratta | |
| D449,422 | S | | 10/2001 | Massie | |
| 2005/0039242 | A1 | * | 2/2005 | Edmondson | 2/207 |

FOREIGN PATENT DOCUMENTS

| | | | |
|---|---|---|---|
| WO | WO0049594 | * | 8/2000 |

* cited by examiner

COLD WEATHER PROTECTION GARMENT

CROSS-REFERENCE TO RELATED APPLICATIONS

This application is a continuation application of U.S. application Ser. No. 11/152,749, filed Jun. 14, 2005 now abandoned, which is a continuation application of U.S. application Ser. No. 10/881,504, filed Jun. 30, 2004, now abandoned.

BACKGROUND OF THE INVENTION

1. Field of the Invention

The present invention relates generally to a method and apparatus directed to a cold weather protection garment which generally includes a scarf with a muff, and a method of forming a muff at the end of a scarf by inserting the end of the scarf through a perforation located within the scarf.

2. Brief Description of the Prior Art

U.S. Pat. No. 4,488,315 to Hoerlein discloses a combination of a scarf and hand puppets. The hand puppets are attached at each end of the scarf as shown in FIG. 1. As shown in FIG. 3, the hand puppet is configured to receive the user's fingers in a glove-like fashion. Similarly U.S. Pat. No. 4,559,647 to Smith et al. discloses a scarf having ends that can be converted into mittens as shown in FIGS. 1 and 2.

U.S. Pat. No. 53,760 to Mahler discloses a muff that includes a cord attached thereto as shown in FIG. 1 for the purposes of "sustaining the muff." The cord is provided to allow the muff to be hung from the user's neck in a similar fashion as the muff that is currently available from Everwood of Paris, France.

U.S. Pat. No. 2,870,448 to Rosenthal discloses a muffler configured to have a vest-like appearance. The muffler includes a row of buttons to connect the opposite sides of the muffler at the user's midsection, and pockets configured to retain articles.

SUMMARY OF THE INVENTION

The present invention is a garment for wearing by a person having a neck and a pair of hands including a scarf and a first muff. The scarf is defined by a first axis, a first end and a second end which is opposite the first end. The first muff is formed at the first end as a first pocket configured to closely receive at least one of the pair of hands of the person. The first pocket has a first opening, a second opening and a second axis extending between the first opening and the second opening which is substantially perpendicular to the first axis.

In a preferred embodiment, the scarf preferably has a substantially uniform width which is selected to be at least as long as a hand of the person as measured from the wrist when the hand is formed as a fist. The first muff is preferably defined by a length measured along the second axis which is substantially equal to the width. The pocket is preferably sized to define a volume from about 150 to about 400 percent of a volume defined by the fist of the person when the pocket is manipulated to substantially define a tubular shape for closely receiving the hand.

In an alternative embodiment, the pocket can be sized to closely receive both pair of hands of the person. Preferably, the width is selected to be at least as long as a hand of the person as measured from the wrist. The first muff can be defined by a length measured along the second axis which is substantially equal to the width. The pocket is preferably sized to define a volumetric space from about 250 to about 400 percent of a percent of a volume defined by the hand measured from the wrist when formed as a fist when the pocket is manipulated to substantially define a tubular shape for closely receiving both pair of hands.

In another preferred embodiment of the invention, the scarf is defined by a first end, a second end opposite the first end, a first side, a second side, and a first axis. The first and second sides extend between the first end and the second end with the second side being substantially parallel to the first side. The first axis runs between the first side and the second side. The first muff is formed at the first end as a pocket configured to closely receive at least one of the pair of hands of the person. The pocket has first and second openings and a second axis. The first opening is associated with the first side and the second opening is associated with the second side. The second axis extends between the first opening and the second opening and is substantially perpendicular to the first axis.

In another preferred embodiment of the invention, the garment also includes a second muff. The second muff is formed at the second end of the scarf as a second pocket configured to closely receive the other hand of the person. The second pocket has third and fourth openings and a third axis. The third opening is associated with the first side and the fourth opening is associated with the second side. The third axis extends between the third opening and the fourth opening and is substantially perpendicular to the first axis.

In another preferred embodiment of the invention, the garment includes a scarf, a first muff-extension portion, and an attachment means. The scarf is defined by a first end, a second end opposite the first end, a first side, and a second side, and a first axis. The first and second sides extend between the first end and the second end with the second side being substantially parallel to the first side. The first axis runs between the first side and the second side. The first muff-extension portion is defined by a third end, a fourth end, a third side and a fourth side. The third end is attached to the first end and the fourth end is opposite the third end. The third and fourth sides extend between the third end and the fourth end with the fourth side being substantially parallel to the third side. The attachment means removably fastens the fourth end to the first end of the scarf to form a pocket configured to closely receive at least one of the pair of hands of the person. The attachment means can be a Velcro fastener, a button, or any suitable means for removably fastening a garment. Preferably the attachment means includes a flap attached to the a fourth end of the first muff-extension and the third end is attached to the first end of the scarf to define a slot.

In another preferred embodiment of the invention, the garment includes a scarf, a first muff, a second muff and a coupler. The scarf is defined by a first end and a second end which is opposite the first end. The first muff is formed at the first end as a first pocket configured to closely receive at least one of the pair of hands of the person. The first pocket has a first opening and a second opening. The second muff is formed at the second end as a second pocket configured to closely receive at least one of the pair of hands of the person. The second pocket has a third opening a fourth opening. The coupler maintains an abutting relationship between one of the openings of the first muff and one of the openings of the second muff.

In a preferred embodiment, the coupler is includes first and second ribbons. The first ribbon is attached to the first muff and the second ribbon is attached to the second muff. The ribbons are configured to be tied together. In alternative embodiments, the coupler can be a button, a Velcro fastener, a zipper, a pair of cooperating magnets or any other suitable means for maintaining an abutting relationship between the openings.

The present invention also includes a method of forming a muff at the end of a scarf. The method includes the steps of providing a garment having a scarf and a first muff-extension portion. The scarf is defined by a first end and a second end which is opposite the first end. The first muff-extension portion is defined by a third end attached to the first end of the scarf and a fourth end opposite the third end. The fourth end is fastened to the first end to form a pocket configured to closely receive at least one of the pair of hands of the person. Preferably the garment includes a flap attached to the fourth end and the third end is attached to the first end of the scarf to define a slot so that the fastening can be performed by inserting the flap through the slot.

For a better understanding of the present invention, reference is made to the following description to be taken in conjunction with the accompanying drawings and its scope will be pointed out in the appended claims.

BRIEF DESCRIPTION OF THE DRAWINGS

Preferred embodiments of the invention have been chosen for purposes of illustration and description and are shown in the accompanying drawings, wherein:

FIG. 14 is a plan view of a twelfth embodiment of the invention; and.

DETAILED DESCRIPTION OF THE INVENTION

Figure 1:
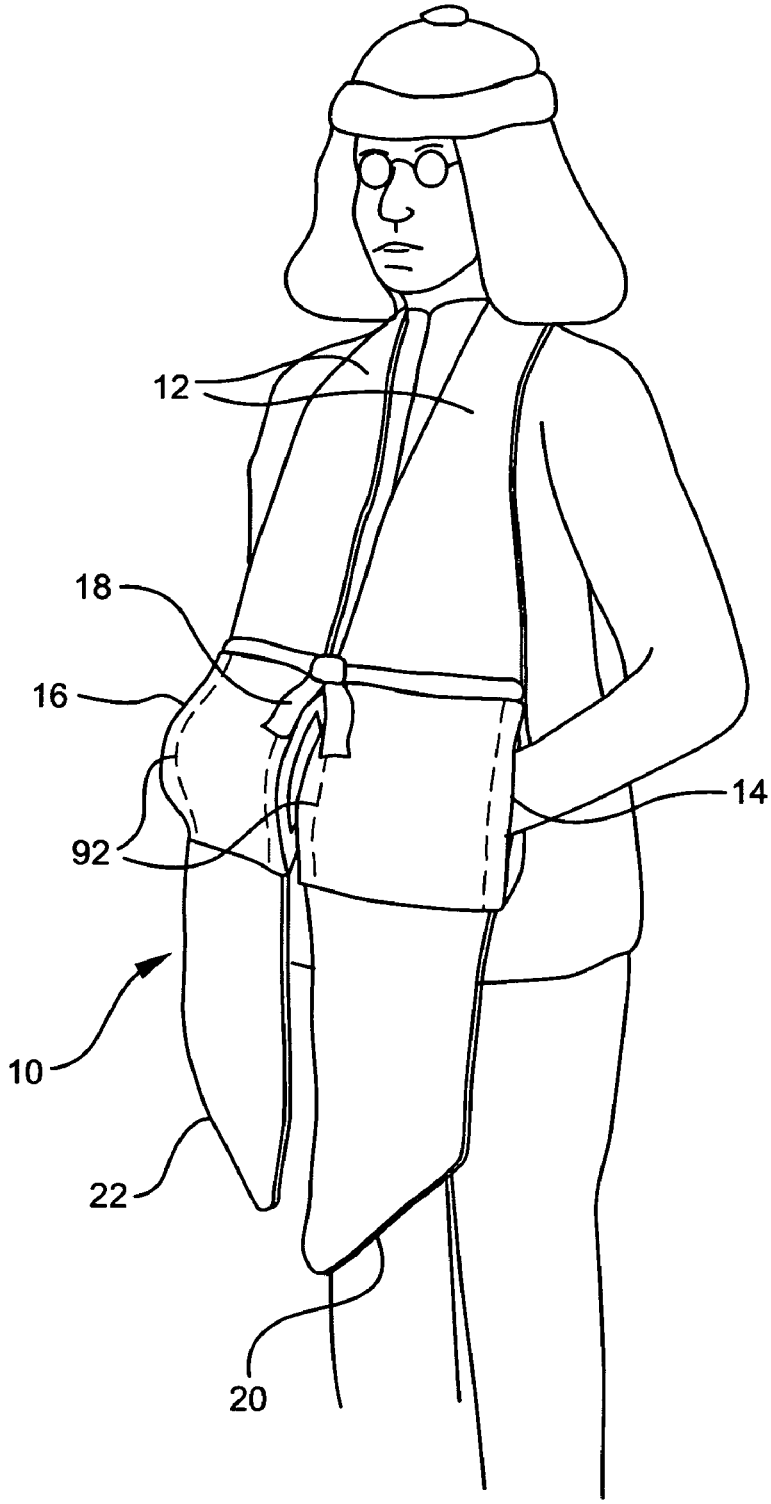
FIG. 1 is a perspective view illustrating a first embodiment of the invention as worn by a person.

Referring initially to FIG. 1, a garment 10 in accordance with the present invention includes a scarf 12, a first muff 14, and a second muff 16. The scarf 12 is configured to be wrapped around a person's neck in the traditional manner. Each of the muffs 14, 16 include a pocket for generally receiving one of the hands of the person wearing the garment 10. The garment 10 preferably includes a coupler 18 for maintaining an abutting relationship between the muffs 14, 16. The garment 10 can also include first and second ornamental extensions 20, 22 that are respectively connected to the first and second muffs 14, 16.

Figure 2:
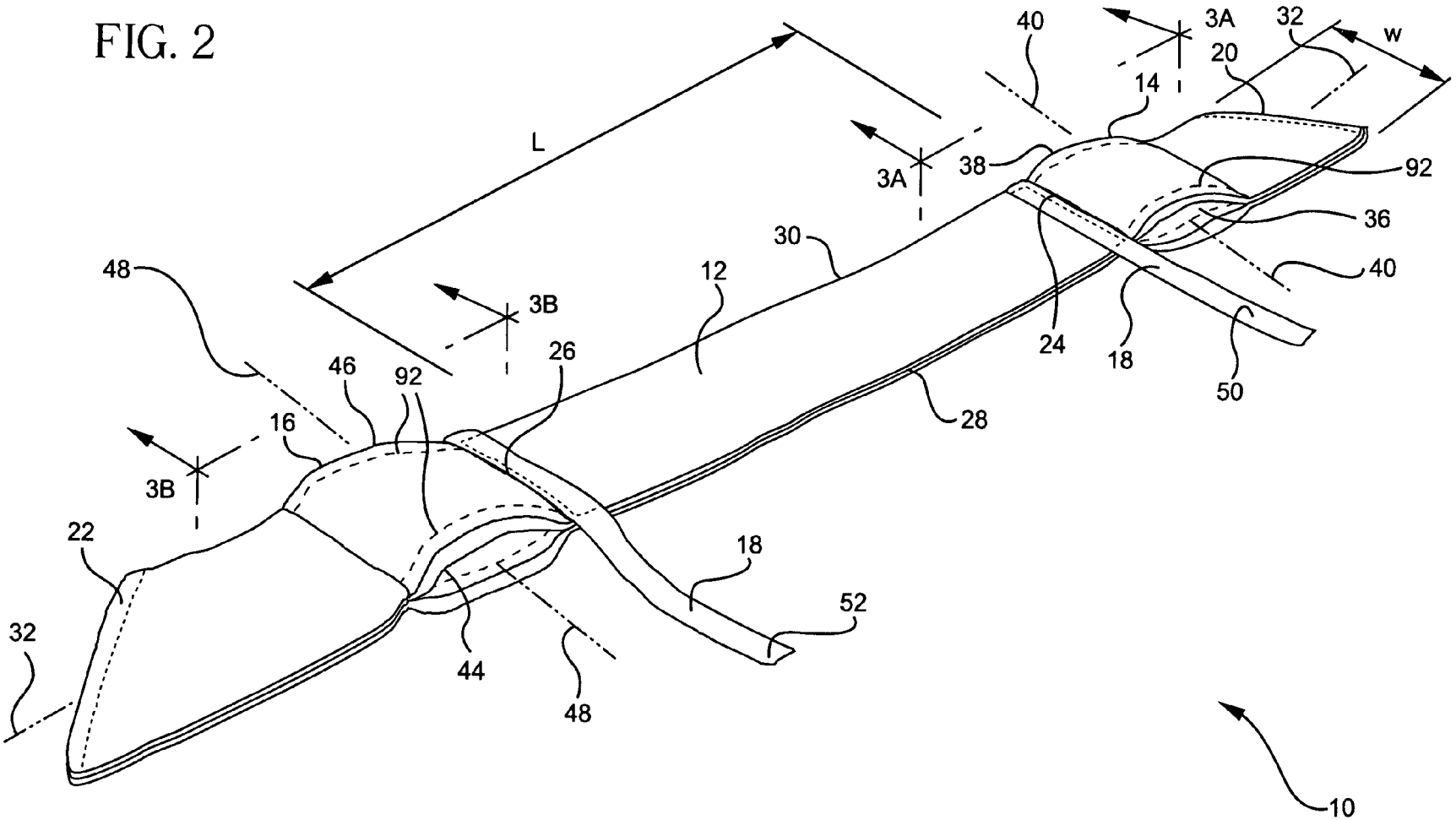
FIG. 2 is a perspective view of the first embodiment of the invention shown in FIG. 1.

Referring now to FIG. 2, the garment 10 is shown in plan view to illustrate the scarf 12, the first and second muffs 14, 16, the coupler 18, and the first and second ornamental extensions 20, 22. The scarf 12 is defined by a first end 24, a second end 26 opposite the first end 24, a first side 28, a second side 30, and a first axis 32. The first and second sides 28, 30 extend between the first end 24 and the second end 26. The second side 30 is preferably arranged to be substantially parallel to the first side 28 with the first axis 32 running between the first side 28 and the second side 30. The scarf 12 preferably has a substantially uniform width, W, which is preferably selected to be at least as long as a hand of the person as measured from the wrist when the hand is formed as a fist. The width, W, is generally defined by said first side 28 and second side 30. The scarf 12 has a length, L, generally selected so that when the garment 10 is wrapped one or more times about the neck of the person the first and second muffs 14, 16 will ride at about the waist of the person. Preferably the length will be selected so that the muffs 14, 16 will be positioned slightly below the navel of the person.

Figure 3A:
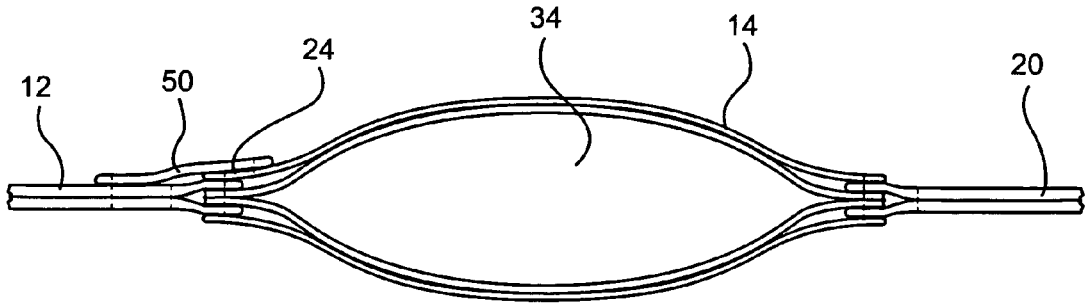
FIG. 3A is a cross sectional view through the first muff of the first embodiment of the invention taken along line 3A-3A of FIG. 2.

Referring now to FIGS. 2, and 3A, the first muff 14 is formed at the first end 24 of the scarf 12 as a first pocket 34. The first pocket 34 is generally configured to closely receive at least one of the pair of hands of the person wearing the garment. The first pocket 34 has first and second openings 36, 38 and a second axis 40. The first opening 36 is associated with the first side 28 and the second opening 38 is associated with the second side 30. The second axis 40 extends between the first opening 36 and the second opening 38 and is preferably substantially perpendicular to the first axis 32. The first muff 14 preferably has a length which is substantially equal to the width, W, of the scarf 12 as measured along the second axis 40.

Figure 3B:
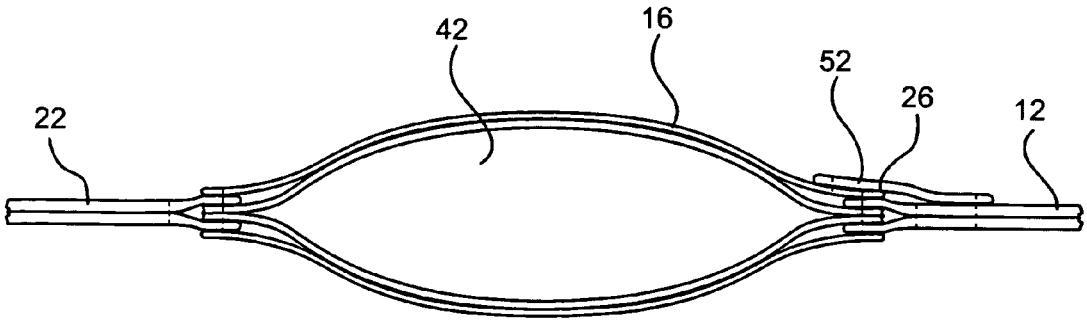
FIG. 3B is a cross sectional view through the second muff of the first embodiment of the invention taken along line 3B-3B of FIG. 2.
Figure 4:
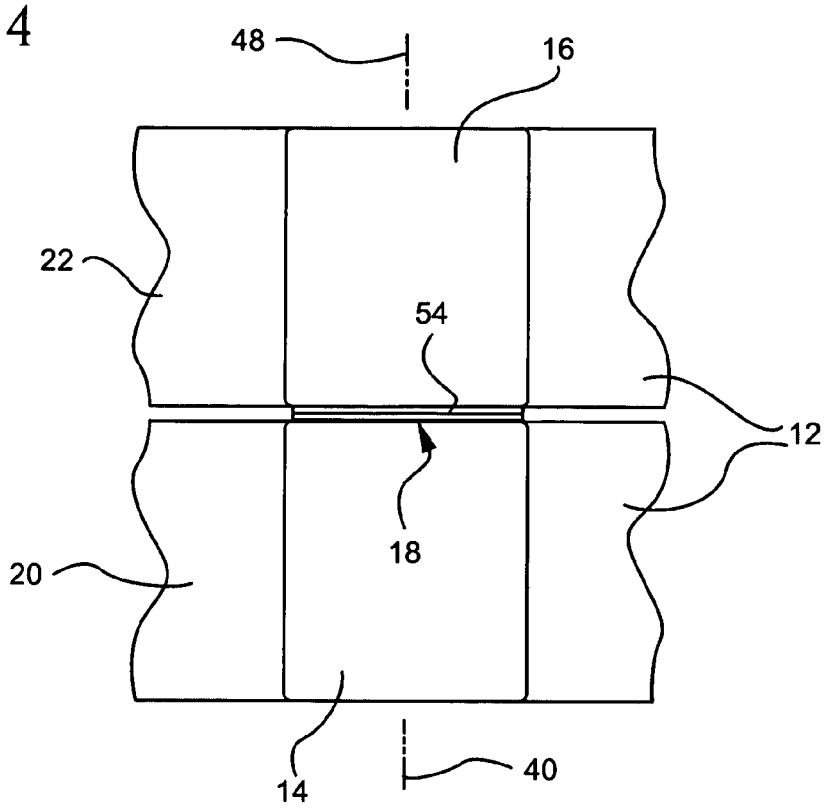
FIG. 4 is a partial plan view at the first and second muffs of a second embodiment of the invention where the coupler is a velcro fastener.
Figure 5:
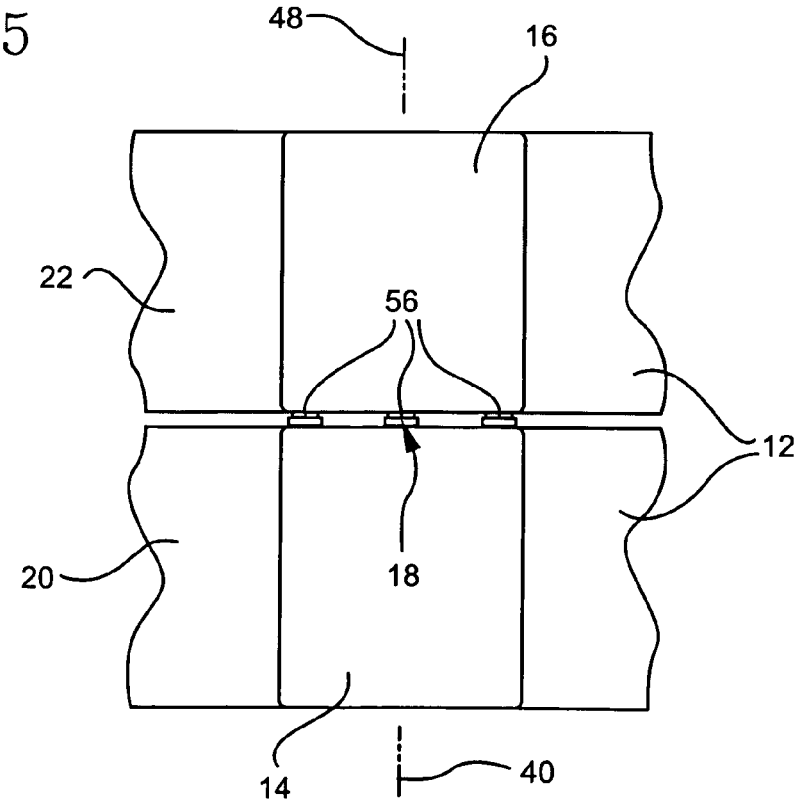
FIG. 5 is a partial plan view at the first and second muffs of a third embodiment of the invention where the coupler includes a plurality of magnets.

Referring now to FIGS. 2, and 3B, the second muff 16 is formed at the second end 26 of the scarf 12 as a second pocket 42. The second pocket 42 is generally configured to closely receive the other hand of the person wearing the garment. The second pocket 42 has third and fourth openings 44, 46 and a third axis 48. The third opening 44 is associated with the first side 28 and the fourth opening 46 is associated with the second side 30. The third axis 48 extends between the third opening 44 and the fourth opening 46 and is preferably substantially perpendicular to the first axis 32. The second muff 16 preferably has a length which is substantially equal to the width, W, of the scarf 12 as measured along the third axis 48.

In preferred embodiments, the first and second pockets 34, 42 are configured to closely receive a person's hand. The term "closely receive" excludes pockets that are tight fitting or as clingy as the fit which is normally associated with a glove. In particular, the pockets 34, 42 are sized to define a volume that provides for a void air space when the hand is inserted into the pocket 34, 42 to manipulate the pocket 34, 42 to define a substantially tubular shape. The size of the volume is preferably from about 150 to about 400 percent of the space defined by the fist of the person measured from the wrist. In addition, the width, W, is preferably selected to be at least as long as a hand of the person as measured from the wrist when formed as a fist. Further, in preferred embodiments the pockets 34, 42 are provided with an elastic band 92 at the openings 36, 38, 44, 46 to partially close the respective opening 36, 38, 44, 46.

In an alternative embodiment, the pockets 34, 42 can be sized to closely receive both pair of hands of the person. In this case, the width, W, is preferably selected to be at least as long as a hand of the person as measured from the wrist. The size of the volume is preferably from about 250 to about 400 percent of the space defined by the fist of the person measured from the wrist.

Referring now to FIGS. 2 and 4 through 8, preferred embodiments of the garment 10 include a coupler 18 for maintaining an abutting relationship between the first and second muffs 14, 16. The coupler 18 maintains an abutting relationship between one of the openings 36, 38 of the first muff 14 and one of the openings 44, 46 of the second muff 16. Referring now to FIG. 2, in one embodiment of the invention the coupler 18 includes a first ribbon 50 attached at the first muff 14 and second ribbon 52 attached at the second muff 16. The ribbons 50, 52 are configured to be tied together to maintain the abutting relationship. The garment 10 can be provided with a pair of narrow pockets located at the ribbons 50, 52 for storing the ribbons 50, 52 when the person wearing the garment 10 does not wish to maintain the abutting relationship between the first and second muffs 14, 16. In another embodiment of the invention, a second set of ribbons or ties can be provided at the bottom of the muffs 14, 16 to further supplement the abutting relationship.

In an alternative embodiment of the invention, the first and second ornamental extensions 20, 22 can be configured to be connected to provide the abutting relationship. In a preferred embodiment, a slot is provided at each end of the scarf 12 to allow the first and second ornamental extensions 20, 22 to be inserted through prior to being connected.

Figure 6:
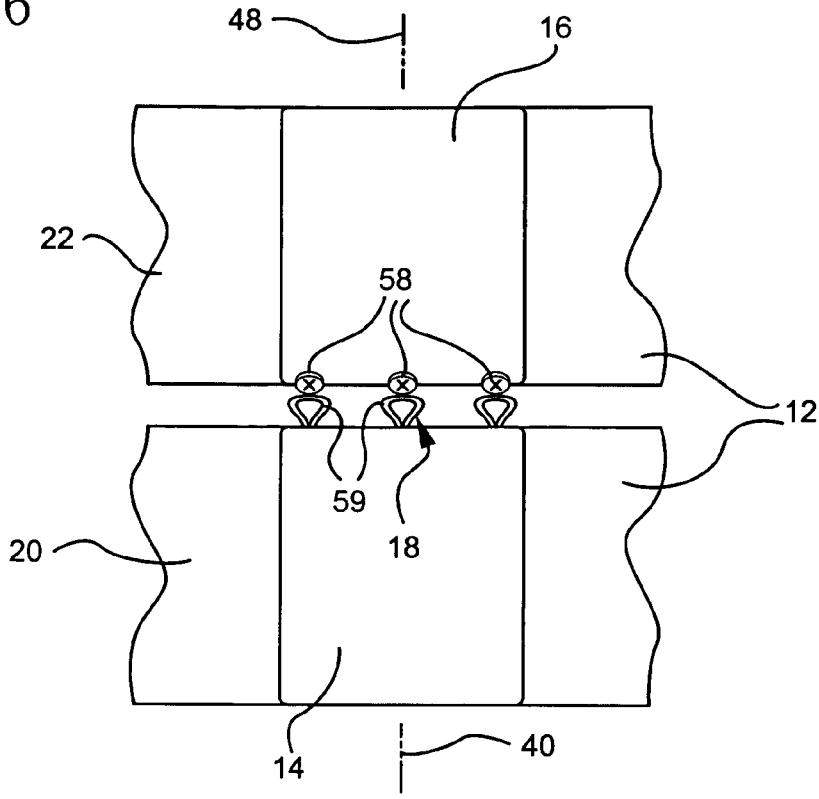
FIG. 6 is a partial plan view at the first and second muffs of a fourth embodiment of the invention where the coupler includes a plurality of traditional buttons.
Figure 7:
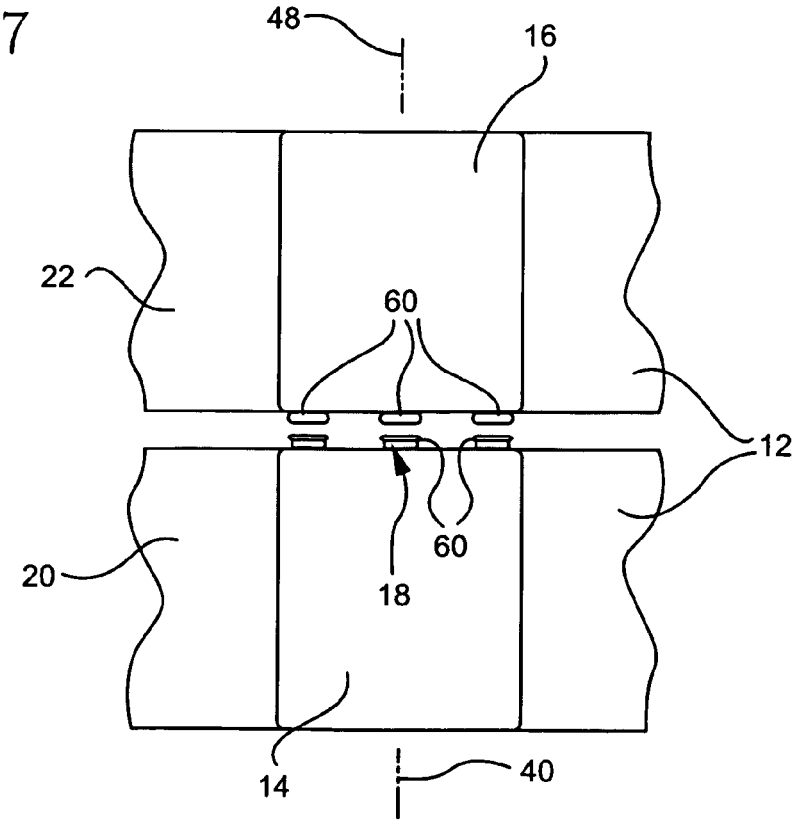
FIG. 7 is a partial plan view at the first and second muffs of a fifth embodiment of the invention where the coupler includes a plurality of snap buttons.
Figure 8:
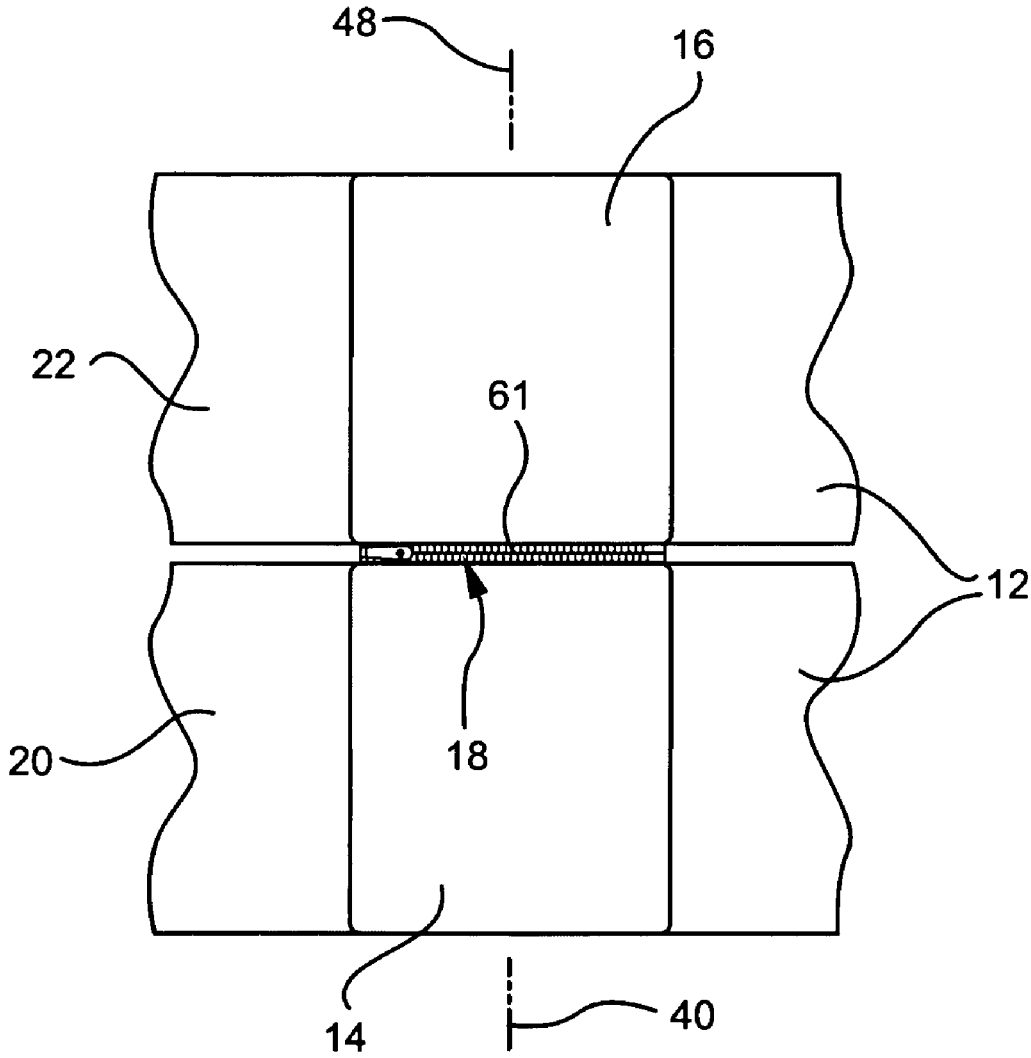
FIG. 8 is a partial plan view at the first and second muffs of a sixth embodiment of the invention where the coupler is a zipper.

The coupler 18 can generally include any suitable two part connector for fastening the first muff 14 to the second muff 16. The coupler 18 is preferably provided at the perimeter of the first and third openings 36, 44, and can be configured to fasten substantially the entire perimeter, a plurality of discrete portions of the perimeters, or only one discrete portion of the perimeters of the openings 36, 44. Suitable two part connectors include a Velcro fastener 54, cooperating magnets 56, traditional buttons 58, cooperating snap buttons 60, or a zipper 61 as shown respectively in FIGS. 4 through 8. Other suitable two part connectors include belt and buckle combinations as well as a clasp. The embodiment that utilizes traditional buttons 58 can have each button 58 configured to cooperate with either a traditional button hole (not shown) or a loop 59 as shown in FIG. 6.

Referring now to FIGS. 9 through 15, in other preferred embodiments of the invention, the garment 100, 200, 300, 400, 500, 600, 700 includes a scarf 12, a first muff-extension portion 62, a second muff-extension portion 64, an attachment means 65 and a second attachment means 67. The scarf 12 is defined by a first end 24, a second end 26 opposite the first end 24, a first side 28, and a second side 30, and a first axis 32. The first and second sides 28, 30 extend between the first end 24 and the second end 26 with the second side 30 being substantially parallel to the first side 28. The first axis 32 runs between the first side 28 and the second side 30.

The first muff-extension portion 62 is defined by a third end 66, a fourth end 68, a third side 70 and a fourth side 71. The third end 66 is attached to the first end 24 and the fourth end 68 is opposite the third end 66. The third and fourth sides 70, 71 extend between the third end 66 and the fourth end 68 with the fourth side 71 being substantially parallel to the third side 70.

The second muff-extension portion 64 is defined by a fifth end 72, a sixth end 74, a fifth side 76 and a sixth side 78. The fifth end 72 is attached to the second end 26 and the sixth end 74 is opposite the fifth end 72. The fifth and sixth sides 76, 78 extend between the fifth end 72 and the sixth end 74 with the sixth side 78 being substantially parallel to the fifth side 76.

The attachment means 65 removably fastens the fourth end 68 to the first end 24 of the scarf 12 to form a first pocket configured to closely receive at least one of the pair of hands of the person. The second attachment means 67 removably fastens the sixth end 74 to the second end 26 of the scarf 12 to form a second pocket configured to closely receive the other hand of the person. The attachment means 65, 67 can include any suitable two part connector for removably fastening a fabric. Preferably, the garment 100, 200, 300, 400 includes a coupler 18 as described above.

Figure 9:
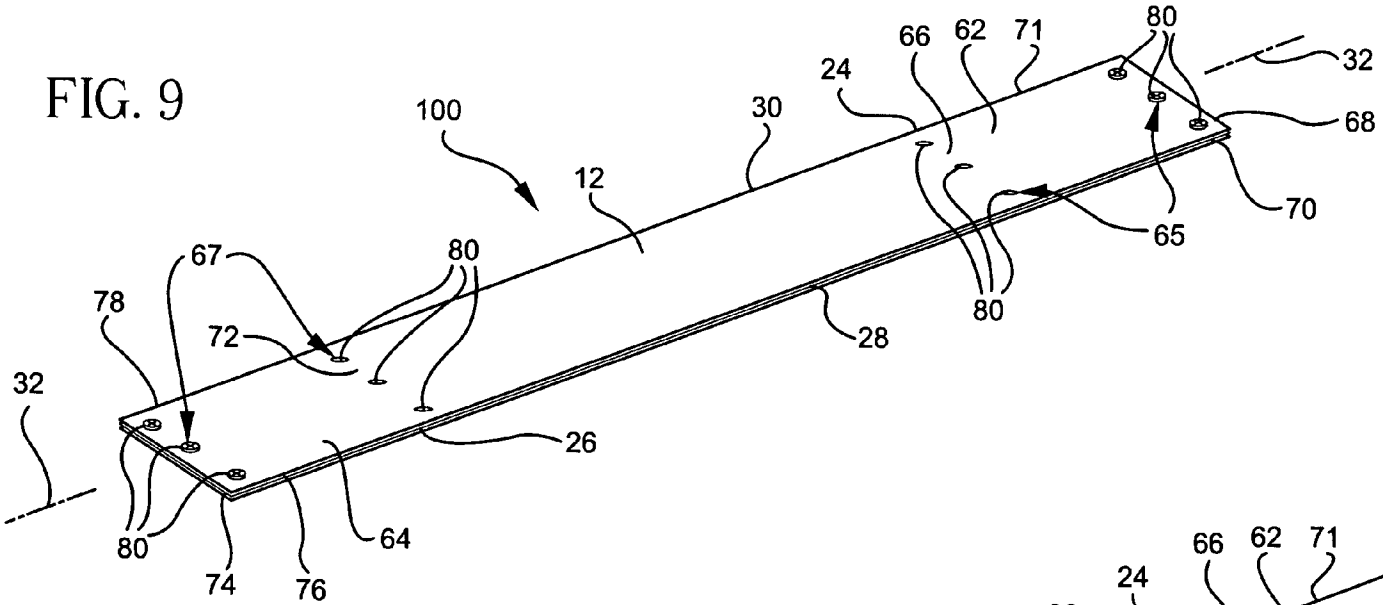
FIG. 9 is a plan view of a seventh embodiment of the invention.

Referring now to FIG. 9, the attachment means 65, 67 can be in the form of a button and hole combination 80. Although the buttons are shown being positioned along the fourth and sixth ends 68, 74 while the holes are shown positioned along the first and second ends 24, 26, these locations could be reversed.

Figure 10:
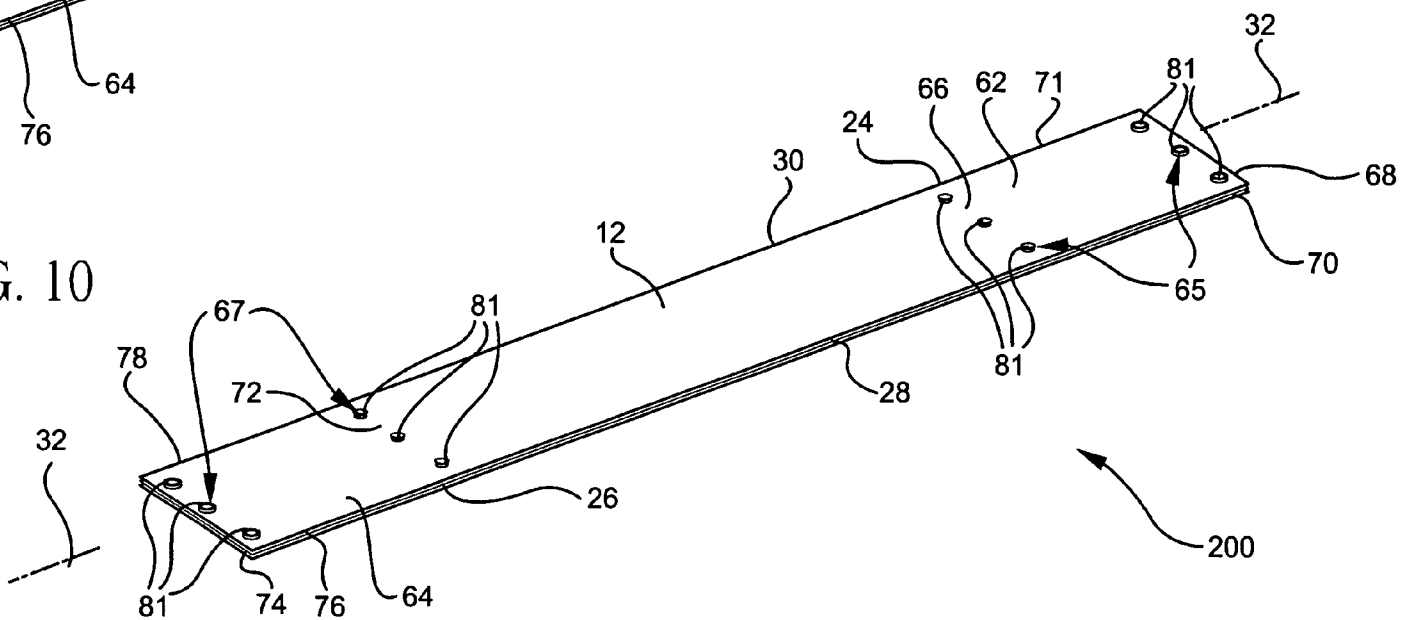
FIG. 10 is a plan view of a eighth embodiment of the invention.
Figure 11:
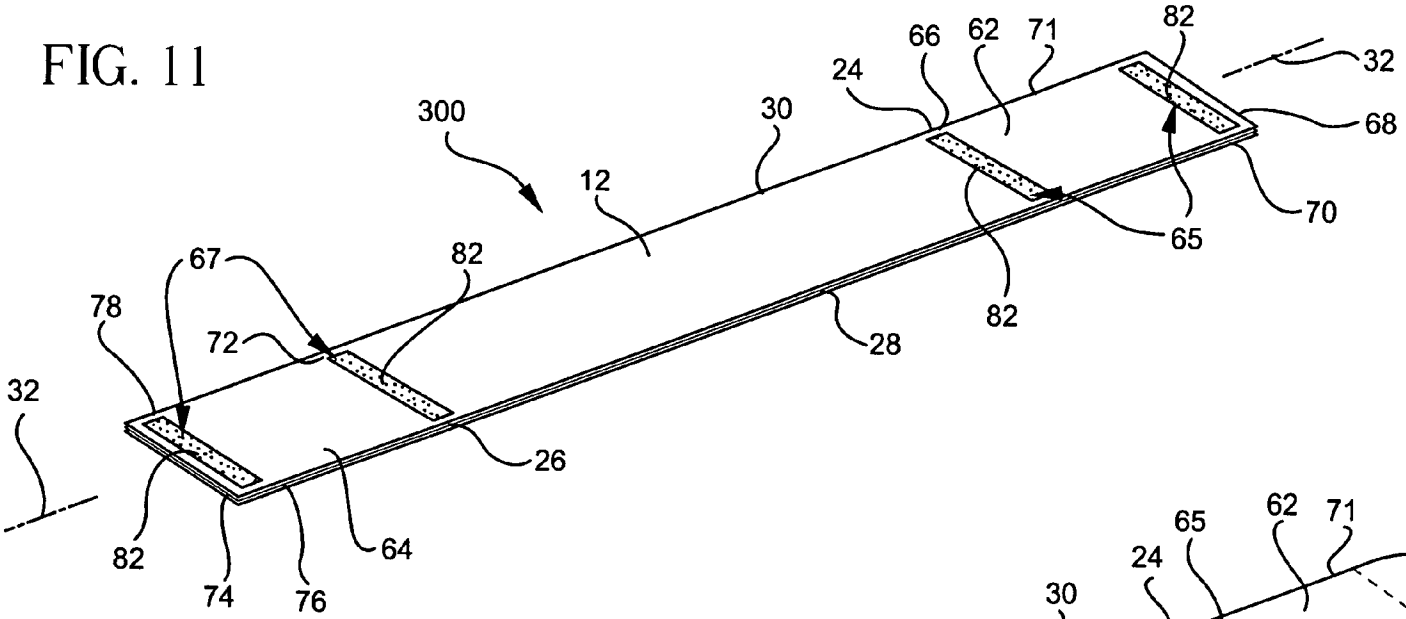
FIG. 11 is a plan view of a ninth embodiment of the invention.

Referring now to FIG. 10, the attachment means 65, 67 can be in the form of two part mechanical connector 81 configured to fasten discrete portions of the ends 66, 68, 72, 74 of the first and second muff-extension portions 62, 64. Suitable mechanical connectors 81 include snap buttons and magnets. The attachment means 65, 67 can also be in the form of a Velcro fastener 82 as shown in FIG. 11.

Figure 12:
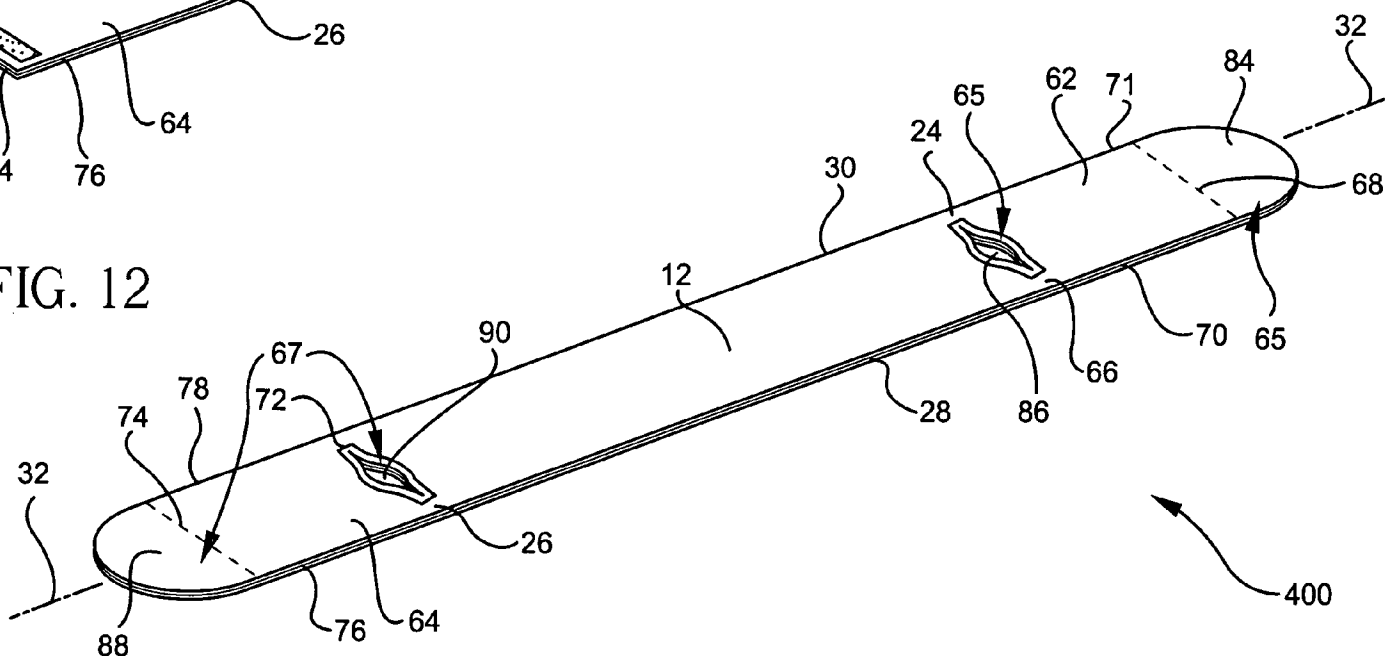
FIG. 12 is a plan view of a tenth embodiment of the invention.

Referring now to FIG. 12, in a preferred embodiment, the attachment means 65 includes a flap 84 attached to the fourth end 68 of the first muff-extension 62 and the third end 66 is attached to the first end 24 of the scarf 12 to define a slot 86. Similarly, the second attachment means 67 includes a second flap 88 attached to the sixth end 74 of the second muff-extension 64 and the fifth end 72 is attached to the second end 26 of the scarf 12 to define a second slot 90. In this embodiment of the invention, the pocket is formed by inserting the flap 84, 88 through the respective slot 86, 90. The slots 86, 90 can include an elastic band about their perimeter to help retain the respective flap 84, 88 after insertion.

Figure 13:
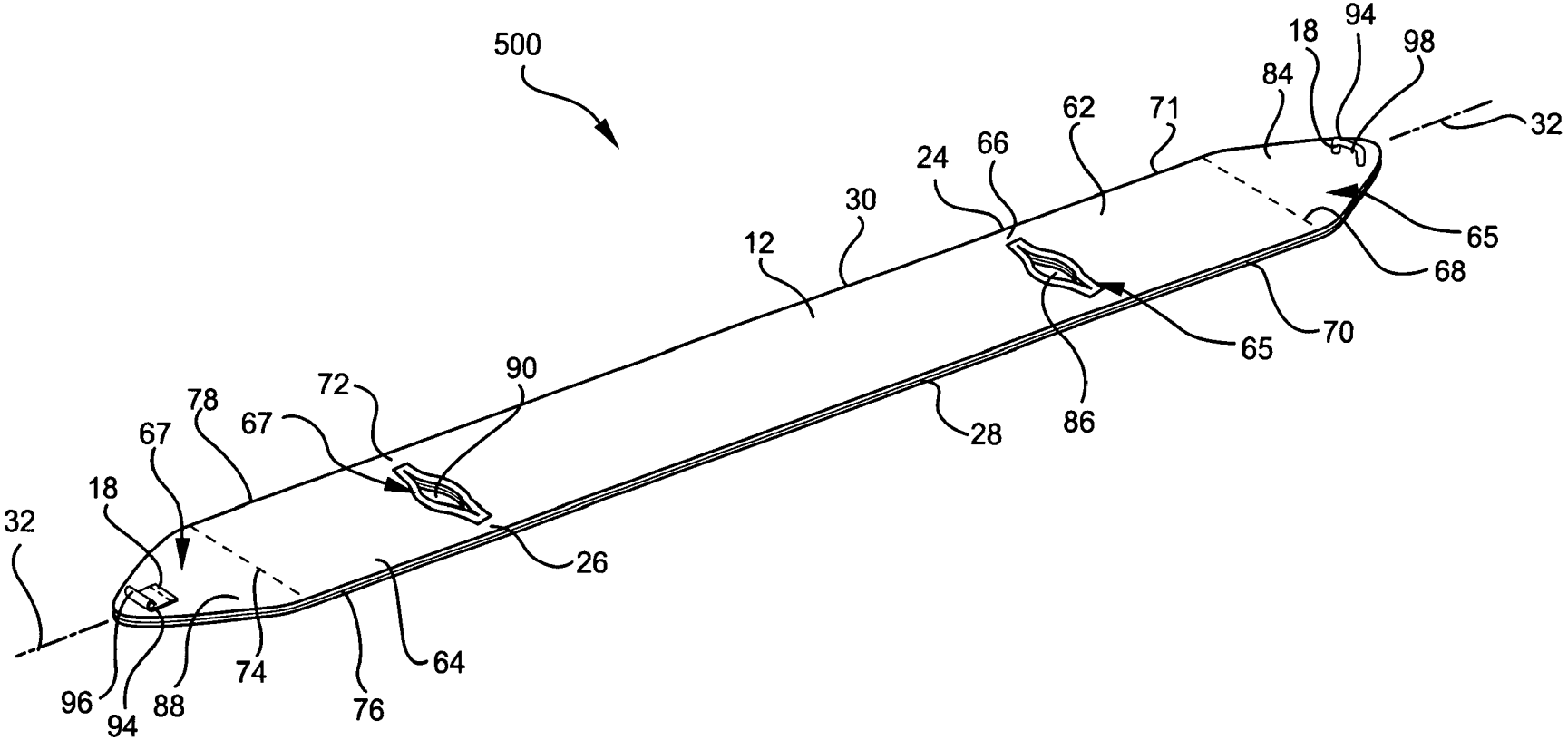
FIG. 13 is a plan view of an eleventh embodiment of the invention.
Figure 14:
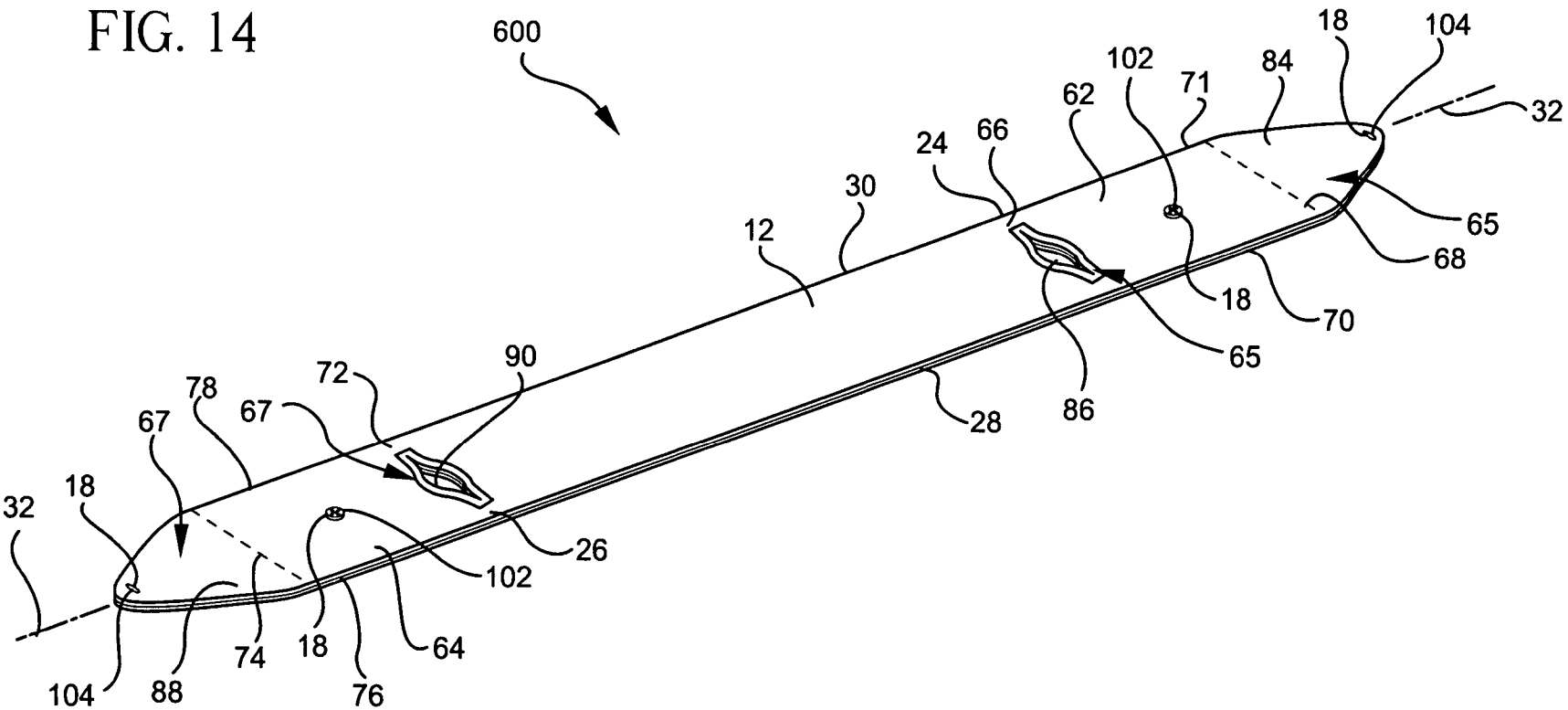
Figure 15:
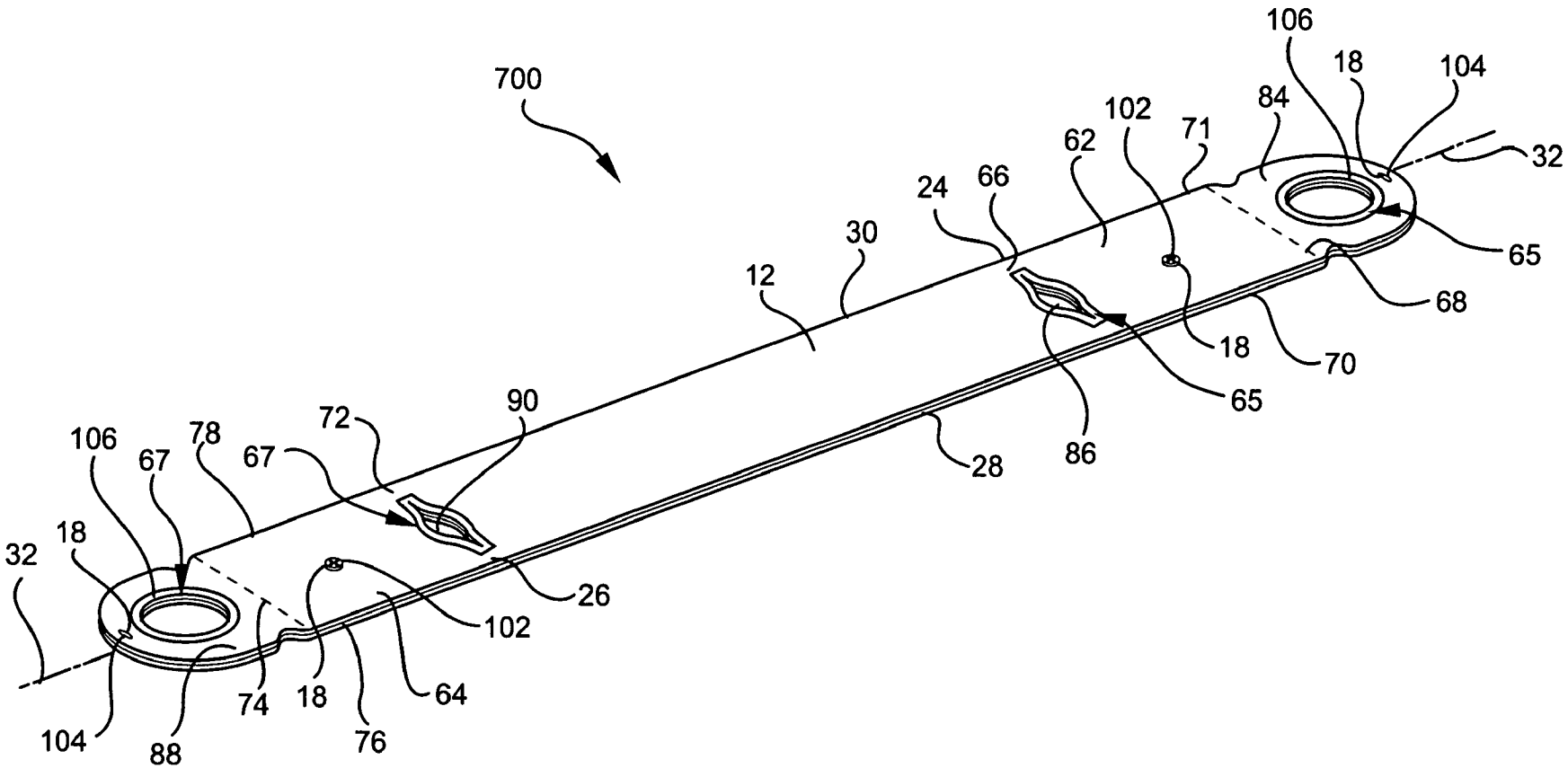
FIG. 15 is a plan view of a thirteenth embodiment of the invention.

Referring now to FIGS. 13 through 15, preferred embodiments that include the flaps 84, 88 can include a coupler 18 for maintaining an abutting relationship between the pocket and the second pocket formed by the first and second muff extensions 62, 64 in a similar manner as discussed above and illustrated in FIGS. 4 through 8. The coupler 18 maintains an abutting relationship between one of the sides 70, 71 of the pocket and one of the sides 76, 78 of the second pocket after the flaps 84, 88 have been inserted through their respective slot 86, 90. The coupler 18 can be configured to removably fasten the flap 84 to the second flap 88 as shown in FIG. 13. In the embodiment shown in FIG. 13, the coupler 18 comprises a clasp 94 having a hook 96 and a bar 98 configured to be removably connectable, but could include any suitable two part connector for removably fastening a fabric as discussed above. The coupler 18 can also be configured to removably fasten the flap 84 to the second muff extension 64 and the second flap 88 to the muff extension 62 as shown in FIGS. 14 and 15. In the embodiments shown in FIGS. 14 and 15, the coupler 18 comprises a traditional button 102 and button hole 104 combination, but could include any suitable two part connector for removably fastening a fabric as discussed above.

Referring now specifically to FIG. 15, preferred embodiments that include the flaps 84, 88 can include a hole 106 formed through one or both of the flaps 84, 88. In this embodiment of the invention, after the pockets are formed by inserting the flaps 84, 88 through the respective slot 86, 90, one of the flaps 84, 88 can be inserted through the hole 106 in the other flap 84, 88 to maintain the abutting relationship. In addition, a two part mechanical connector 18 such as those described above can also be used to supplement the abutting relationship. Preferably the width of the flap 84, 88 is narrowed adjacent to the fourth and sixth ends 68, 74 to identify the extent of the first and second muff extensions 62, 64 for the user. The hole 106 can include an elastic band about is perimeter to help retain the respective flap 84, 88 after insertion. In alternative embodiments, the ends 68, 74 can be identified through the use of different fabric colors and textures.

Referring to FIGS. 2 and 9 through 15, the garment 10, 100, 200, 300, 400, 500, 600, 700 generally has at least a two ply construction as shown in FIGS. 3A and 3B. The actual number of plies will vary depending upon the ornamental design and fabrics selected for same. The two ply construction may either be provided through a tubular weave having no seams, folding a panel and having one seam, or by fastening two panels and having two seams. The invention also contemplates that the separate elements of the invention—scarf, muff, muff-extensions—can be formed as part of a continuous panel. In general, the garment will be constructed to provide the person wearing the garment protection from cold weather. The invention contemplates that both the scarf and muff elements will be constructed from a variety of materials that when combined provide warmth and thermal insulation to the person.

Thus, while there have been described what are presently believed to be the preferred embodiments of the invention, those skilled in the art will realize that changes and modifications may be made thereto without departing from the spirit of the invention, and is intended to claim all such changes and modifications as fall within the true scope of the invention.

What is claimed is:

1. A garment to be worn by a person having a neck and a pair of hands, said garment comprising:

a scarf defined by:

a first end;

a second end opposite said first end;

a first side extending between said first end and said second end;

a second side extending between said first end and said second end and being substantially parallel to said first side; and a first axis running between said first side and said second side;

a first muff formed at said first end as a first pocket configured to closely receive at least one of the pair of hands of the person, said first pocket having: a first opening associated with said first side;

a second opening associated with said second side; and a second axis extending between said first opening and said second opening and being substantially perpendicular to said first axis; and a second muff formed at said second end as a second pocket configured to closely receive at least one of the pair of hands of the person, said second pocket having:

a third opening associated with said first side;

a fourth opening associated with said second side; and a third axis extending between said third opening and said fourth opening and being substantially perpendicular to said first axis;

the second and fourth openings and respective second sides being alignable with each other to create an elongated composite muff from the first and second muffs able to simultaneously accommodate the pair of hands.

2. The garment as defined by claim 1, wherein said scarf has a width defined by said first side and second side which is selected to be at least as long as a hand of the person as measured from the wrist when the hand is formed as a fist;

said first muff is defined by a length measured along said second axis which is substantially equal to said width; and said second muff is defined by a second length measured along said third axis which is substantially equal to said width.

3. A garment for wearing by a person having a neck and a pair of hands, said garment comprising:

a scarf defined by:

a first end;

a second end opposite said first end;

an elongated intermediate portion extending between the first and second ends adapted and constructed for embracing the neck, said intermediate portion having a first side extending between said first end and said second end and a second side extending between said first end and said second end and being substantially parallel to said first side; and a first axis running between said first side and said second side;

a first muff-extension portion defined by:

a third end attached to said first end of said scarf;

a fourth end opposite said third end;

a third side extending between said third end and said fourth end; and a fourth side extending between said third end and said fourth end and being substantially parallel to said third side; and an attachment means for removably fastening said fourth end to said first end of said scarf to form a pocket configured to closely receive at least one of the pair of hands of the person;

said pocket being sized to closely receive both pair of hands of the person and having:

a first opening associated with said first side;

a second opening associated with said second side; and a second axis extending between said first opening and said second opening and being substantially perpendicular to said first axis;

said scarf having a width defined by said first side and second side which is selected in connection with the size of the pair of hands of the person;

said first muff-extension being further defined by a length measured along said second axis which is substantially equal to said width.

4. A garment for wearing by a person having a neck and a pair of hands, said garment comprising:

a scarf defined by:

a first end;

a second end opposite said first end;

a first side extending between said first end and said second end;

a second side extending between said first end and said second end and being substantially parallel to said first side; and a first axis running between said first side and said second side; a first muff-extension portion defined by:

a third end attached to said first end of said scarf;

a fourth end opposite said third end;

a third side extending between said third end and said fourth end; and a fourth side extending between said third end and said fourth end and being substantially parallel to said third side; and a second muff-extension portion defined by:

a fifth end attached to said second end of said scarf;

a sixth end opposite said fifth end;

a fifth side extending between said fifth end and said sixth end; and a sixth side extending between said fifth end and said sixth end and being substantially parallel to said third side;

an attachment means for removably fastening said fourth end to said first end of said scarf to form a pocket configured to closely receive at least one of the pair of hands of the person; and a second attachment means for removably fastening said sixth end to said second end of said scarf to form a second pocket configured to closely receive at least one of the pair of hands of the person.

5. The garment as defined by claim 4, further comprising a coupler for maintaining an abutting relationship between:

one of said third side and said fourth side of said pocket; and one of said fifth side and said sixth side of said second pocket.

6. The garment as defined by claim 5, wherein:

said attachment means comprises a flap attached to said fourth end of said first muff-extension and said third end is attached to said first end of said scarf to define a slot; and said second attachment means comprises a second flap attached to said sixth end of said second muff-extension and said fifth end is attached to said second end of said scarf to define a second slot.

7. The garment as defined by claim 6, wherein said coupler is configured to removably fasten said flap to said second flap.

8. The garment as defined by claim 7, wherein said coupler is a clasp.

9. The garment as defined by claim 6, wherein said coupler is configured to: removably fasten said flap to said second muff extension; and removably fasten said second flap to said muff extension.

10. A method of forming a muff at the end of a scarf for wearing about a neck by a person having a neck and a pair of hands, said method comprising the steps of:

(a) providing a garment having:

a scarf defined by a first end and a second end which is opposite said first end and an intermediate portion between the first and second ends adapted and constructed for embracing the neck; and a first muff-extension portion defined by a third end attached to said first end of said scarf and a fourth end opposite said third end, a flap being attached to said fourth end and said third end being attached to said first end to define a slot;

(b) fastening said fourth end of said first muff-extension to said first end of said scarf by inserting said flap through said slot to form a pocket configured to closely receive at least one of the pair of hands of the person.

* * * * *